United States Patent [19]

Häep

[11] 4,211,168

[45] Jul. 8, 1980

[54] FIN-STABILIZED PRACTICE MISSILE

[75] Inventor: Heinz Häep, Duesseldorf, Fed. Rep. of Germany

[73] Assignee: Rheinmetall GmbH, Duesseldorf, Fed. Rep. of Germany

[21] Appl. No.: 946,052

[22] Filed: Sep. 26, 1978

[30] Foreign Application Priority Data

Oct. 26, 1977 [DE] Fed. Rep. of Germany ... 7732971[U]

[51] Int. Cl.[2] ..... F42B 13/20

[52] U.S. Cl. ..... 102/41

[58] Field of Search ..... 102/41, 92.7

[56] References Cited

FOREIGN PATENT DOCUMENTS 1009067 5/1957 Fed. Rep. of Germany ..... 102/41

OTHER PUBLICATIONS

"Rheinmetall, Waffemtechnisches Handbuch", Dec. 1972, pp. 466–467.

*Primary Examiner*—Stephen C. Bentley

[57] ABSTRACT

There is disclosed a fin-stabilized unarmed missile for impact diagram target shooting. The missile has an essentially cylindrical body to the rearwardly tapered rear end of which there is affixed a winged tail unit. The missile body has a transverse front end portion extending at a right angle with respect to the axis of the missile body. A forwardly extending pin coaxial of the missile body is secured at its rear end in a central passage in the front end portion of the missile body. The forward end of the pin has an annular flange thereon which creates pressure equalization about the missile as it travels through the air.

7 Claims, 1 Drawing Figure

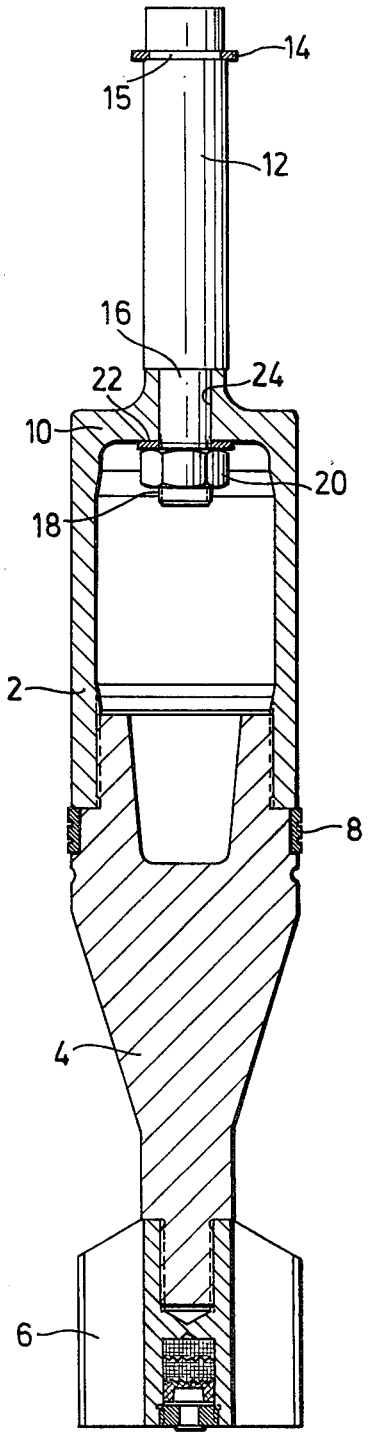
14
15
12
16
22
24
10
20
18
2
8
4
6

FIN-STABILIZED PRACTICE MISSILE

The invention relates to a fin-stabilized unarmed practice missile for impact diagram target shooting.

The missile of the invention comprises an essentially cylindrical missile body to the rearwardly tapered rear end of which there is affixed a winged tail unit. The missile body has a transverse front end portion extending at a right angle with respect to the axis of the missile body. The front end portion of the missile body receives a forwardly extending pin coaxial of the missile body, the pin having an annular flange adjacent its front end.

In shape, dimension and weight such practice missile resembles a corresponding live missile wherein the pin contains adjacent its forward end a fuse located at the required distance from the body of the missile for setting off the hollow charge therein. The practice missile, which contains neither powder nor fuse caps, is used for training purposes, i.e.. for practising loading, unloading and shooting. In place of the explosive charge, an inert mass of the same density can be pressed or poured into the missile body, or a hollow cavity is left therein, so long as in every other respect the practice missile has exactly the same dimensions, weight, center of gravity and ballistic properties as the live missile. Accordingly, the same firing table can be used with impact diagram target shooting with the practice missile and with actual shooting of the live missile. In the practice missile the fuse is replaced by an imitation fuse.

Practice missiles of the aforementioned type are used for impact diagram target shooting by omitting the charge in known fin-stabilized hollow-charge missiles, or by replacing the charge therein by an inert mass. Fin-stabilized hollow-charge missiles are shown, for example, on pages 466 and 467 of "Rheinmetall, Waffemtechnisches Handbuch", published in December, 1972. Hollow-charge missiles of the aforementioned type are of such shape that the winged tail unit has practically the same caliber as the missile body. With a relatively short missile of this type, it is possible to achieve the required stabilization of the missile only if, by providing the missile head with a special shape, a circular airstream is produced which creates pressure equalization as the missile travels through the air, thus reducing the destabilizing forces of the air at the missile head.

It is among the objects of the present invention to provide a practice missile of the aforementioned type which has the same ballistic properties as the corresponding live-hollow charge missile, and which can thus be used for impact diagram target shooting while using the same firing tables as those employed for use with the corresponding live missiles. The practice missile of the invention is simple and inexpensive to manufacture, and is storable for limitless periods, and at the same time is insensitive to errors in handling.

By dividing the missile into an essentially cylindrical missile body, a tapered rear end carrying the winged tail unit, and a pin affixed to the front end portion of the missile body, it is possible, by choosing appropriate materials, to give these parts such shape as to achieve exactly the same weight, center of gravity and the same dimensions as those of the corresponding live missile, and thus also to give the practice missile the same ballistic properties as the live missile. In addition to this, each part of the practice missile may be manufactured according to the most suitable manufacturing process and semifinished parts may also be used which require only to be given the finishing touches.

Further details and advantages of the invention will become obvious from the following description and exemplary embodiment thereof shown in the accompanying drawing, in which:

The single FIGURE of the drawing illustrates the preferred embodiment of the practice missile according to the invention partially in elevation and partially in longitudinal section.

Turning now to the drawing, the practice missile thereshown essentially comprises a hollow cylindrical missile body 2, the rear part of which is screwed to a tapered rear end portion 4 of the missile. The missile body 2 is, for example, made of steel and is produced by the extrusion molding method. At the rear tip of the missile there is provided a winged tail unit 6 which has practically the same diameter as the missile body 2. At the connecting groove between the missile body 2 and the tapering rear section 4 there is arranged a driving band 8 which is rotatable with respect to the other parts of the missile, since the missile is designed to be fired from a rifled gun barrel but without the missile itself being subjected to spin.

The missile body 2 has a front end portion 10 disposed transversely of or normal to the longitudinal axis of the missile body. In the front end portion 10 of the missile body 2 there is provided an axially extending hole 24 which may be formed therein by drilling. Hole 24 serves to receive a reduced diameter cylindrical extension 16 of a forwardly extending pin 12 disposed coaxial of the missile body, extension 16 making a tight fit with the hole 24. The extension 16 of the pin is joined to the main portion of the pin 12 at a right angled shoulder, as shown. The shoulder on the pin 12 is forcibly drawn against the front face of front end portion 10 of the missile body by means of a nut 20 which is screwed onto a thread 18 on the rear end portion of the cylindrical extension 16 which extends rearwardly of the front end portion 10 of the missile body. Between the nut 20 and the inside of the front end portion 10 of the missile body there is provided a washer 22. Such unit 20 can be caulked or riveted to the threaded pin or by riveting or upsetting the rear end of extension 16 so as to prevent the nut from loosening. The pin 12 may be made of a material different from that of which the body 2 is made. Thus pin 12 may be made, for example, of aluminum or other desired material to obtain the desired weight and balance of the practice missile. The connection between pin 12 and the missile body 2 can also be achieved by a compression joint with the hole 24 which, if required, is also protected by caulking or riveting the rear end portion of the pin 12.

In the case of live missiles the front end of the pin 12 has a cap which protects the fuse arranged beneath it. For aerodynamic reasons this cap has a radially protruding flange. Accordingly, such a flange is provided in the practice missile of the present invention, such flange being the form of a spring or a split lock washer 14 which is disposed in an annular groove 15 arranged adjacent the front end of the pin 12.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A fin-stabilized unarmed practice missile for impact diagram target shooting, comprising an essentially cylindrical missile body having a rearwardly tapered rear end, a winged tail unit affixed to the tapered rear end, the body having a front end portion extending normal to the axis thereof, the front end portion having an axially extending opening therein, a forwardly extending pin formed separately from the missile body disposed axially of the missile body, the pin having its rear end received in the opening in the front end portion of the missile body, means securing the pin to the front end portion of the missile body, and a radially outwardly extending annular flange on the pin disposed normal to the axis of the pin and adjacent to the forward end thereof to create pressure equalization about the missile as the missile travels through the air.

2. A missile according to claim 1, wherein the missle body and the pin are made from different materials.

3. A missile according to claim 1, wherein the means securing the pin to the front end portion of the missile body comprises a screw threaded connection between the pin and the front end portion of the missile body.

4. A missile according to claim 1, wherein the means securing the pin to the front end portion of the missile body comprises a compression joint.

5. A missile according to claim 3, wherein the pin is provided with a rear end portion of reduced diameter connected to the main part of the pin at an annular shoulder, the rear end portion of the pin tightly fitting within the opening in the front end portion of the missile body, the rear end of the pin being threaded and extending through the passage in the front end portion of the body, and a nut threaded on the threaded rear end portion of the missile body to draw the shoulder on the pin forcibly against the front face of the front end portion of the missile body.

6. A missile according to claim 3, wherein the pin is provided with a rear end portion of reduced diameter connected to the main part of the pin at an annular shoulder, the rear end portion of the pin tightly fitting within the opening in the front end portion of the missile body, the rear end of the in being threaded and extending through the passage in the front end portion of the body, and the free rear end of the pin rearwardly of the front end portion of the missile body is upset to form a riveted connection between the pin and the missile body.

7. A missile according to claim 1, wherein the flange on the forward end of the pin is formed by a split lock washer seated in a circumferential groove adjacent the forward end of the pin.

* * * * *